US005256095A

United States Patent [19]

Takegawa et al.

[11] Patent Number: 5,256,095

[45] Date of Patent: Oct. 26, 1993

[54] METHOD OF FABRICATING AN ELECTRODE FOR A DISCHARGE LAMP AND THE ELECTRODE FORMED THEREBY

[75] Inventors: Yoshinobu Takegawa, Nara; Shigetoshi Sakon, Shijonawate; Shuji Yamada, Ashiya, all of Japan

[73] Assignee: Matsushita Electric Works, Ltd., Osaka, Japan

[21] Appl. No.: 976,582

[22] Filed: Nov. 16, 1992

[30] Foreign Application Priority Data

Nov. 25, 1991 [JP] Japan ..... 3-308992
May 25, 1992 [JP] Japan ..... 4-132527

[51] Int. Cl.[5] ..... H01J 9/04

[52] U.S. Cl. ..... 445/6; 445/26; 445/51; 313/345; 313/491; 427/77

[58] Field of Search ..... 445/6, 26, 51; 427/77; 313/345, 346 R, 633, 491

[56] References Cited

U.S. PATENT DOCUMENTS 1,699,639 1/1929 Van Gessel ..... 313/346 R
3,612,828 10/1971 Siegla ..... 219/463
4,582,980 4/1986 Izzi ..... 219/505
4,836,816 6/1989 Bouchard et al. ..... 445/51

FOREIGN PATENT DOCUMENTS 54-121660 9/1979 Japan .
54-142965 11/1979 Japan ..... 313/346 R

*Primary Examiner*—Kurt C. Rowan
*Assistant Examiner*—Jeffrey T. Knapp
*Attorney, Agent, or Firm*—Kenyon & Kenyon

[57] ABSTRACT

An electrode of a discharge lamp which has an improved adhesion between an emitter material and a filament is formed in accordance with the following method. That is, a Fe-Cr-Al alloy is used as the filament. The filament is placed in a heated oxidizing environment to precipitate an aluminum oxide layer uniformly in a surface thereof. Thus precipitated aluminum oxide layer has good adhesion with the filament without flaking thereof. The aluminum oxide layer is coated with triple carbonates consisting of barium carbonate, calcium carbonate and strontium carbonate, so that a carbonate coated filament is obtained. And then, the coated filament is heated in vacuum to reduce the carbonates to their alkaline earth oxides of the emitter material, and also to form a complex oxide consisting of the aluminum oxide and the alkaline earth oxides. Adhesion between the emitter material and the aluminum oxide layer is improved by the formation of the complex oxide, so that a lamp life of the discharge lamp is remarkably increased. On the other hand, since the Fe-Cr-Al alloy has a much higher specific resistance value than tungsten, the discharge lamp using the filament of the Fe-Cr-Al alloy can be operated by a small current, which in turn enables a lamp driving circuit to be reduced in size and weight.

17 Claims, 1 Drawing Sheet

METHOD OF FABRICATING AN ELECTRODE FOR A DISCHARGE LAMP AND THE ELECTRODE FORMED THEREBY

BACKGROUND OF THE INVENTION

1.Field of the invention

The present invention is directed to a method of fabricating an electrode for a discharge lamp which comprises precipitating an aluminum oxide layer in a surface of a Fe-Cr-Al alloy and forming an emitter material on the aluminum oxide layer, and the electrode formed thereby.

2.Description of the prior art

An electrode for a discharge lamp such as a fluorescent lamp is generally fabricated by the following method. That is, a tungsten filament is coated with a carbonate suspension of alkaline earth metals which consist of barium, calcium and strontium, so that a carbonate coated filament is obtained. And then, the carbonate coated filament is heated in vacuum to reduce the carbonates to their oxides. Since the oxides have relatively low work functions, they are able to supply thermo electrons with a low voltage. Therefore, the oxides are utilized as an emitter material for the discharge lamp. By the way, it is known that a lamp life of the discharge lamp depends on a depletion of the emitter material during lamp operation. That is, the emitter material is evaporated from thus fabricated electrode by an ion bombardment of a fill gas which is filled in an envelope of the discharge lamp, and also by heating the electrode at a high temperature of about 1000° C. to operate the lamp. As the thus evaporated emitter material attaches on an inner surface of the envelope, a light output of the lamp is depreciated. Therefore, one way to increase the lamp life is to improve adhesion between the emitter material and a filament. On the other hand, it is desired that a lamp driving circuit for the discharge lamp is reduced in size and weight. In case of using the tungsten filament to the discharge lamp, an electrical conductivity of the tungsten filament remarkably increases as a temperature of the tungsten filament increases. The tungsten filament has a low specific resistance at a room temperature, for example, 5.49$\mu\Omega$cm at 20° C. The room temperature mentioned in this specification is in a range of 0° C. to 40° C. A large amount of current flows through the tungsten filament as a rush current immediately after a lamp voltage is applied to operate the lamp. However, when the tungsten filament is heated at about 1000° C. during the lamp operation, the specific resistance of the tungsten filament increases to 24.93$\mu\Omega$cm. As the temperature of the tungsten filament is higher, an amount of current flowing through the tungsten filament decreases. Therefore, the lamp driving circuit corresponding to a large difference of specific resistances of the filament between at the room temperature and the high temperature desired for the discharge lamp. In addition, as the tungsten filament has a low electrical resistance value at the high temperature, as described above, a relatively large amount of current is required to keep the tungsten filament to the high temperature during the lamp operation. Therefore, the lamp driving circuit corresponding to the large amount of current also is needed for the discharge lamp. In order to enable reduction in size and weight of the lamp driving circuit for the discharge lamp, it is desired that a filament material has a small difference of specific resistances of the filament between the room temperature and the high temperature, and also a higher specific resistance value at the high temperature compared with the tungsten filament. The discharge lamp using the filament material can be operated by a small current, which in turn enables the lamp driving circuit to be reduced in size and weight. For example, a heater wire such as a Fe-Cr-Al alloy and Ni-Cr alloy has a small difference of the specific resistances between room temperature and the high temperature, and a relatively high specific resistance value at the high temperature. However, when the heater wire is used as the filament material of the lamp, there is a possibility of the filament deforming or melting during the lamp operation because the heater wire has a lower melting point than tungsten.

Japanese Patent Early Publication [KOKAI] No. 54-121660 describes a cathode for Braun tube. An interface layer which is composed of alumina and barium oxide or silica and barium oxide is formed between the alkaline earth oxides of the emitter material and a cathode substrate. The cathode substrate consists of 20 to 30 wt % of tungsten, 0.01 to 5 wt % of zirconium as a reducer and the balance of nickel. An emission of thermo electrons from the cathode is stably maintained for a long time period by controlling a depletion rate of the reducer, so that a life of the braun tube is increased. The depletion rate of the reducer is controlled by the interface layer.

U.S. Pat. No. 4,836,816 describes about a method of treating a tungsten cathode for increasing a lamp life of the fluorescent lamp. The tungsten cathode is coated with a triple carbonate suspension, and then is placed in a heated oxidizing environment in order to form a diffuse coating consisting of the triple carbonates and tungsten oxide. The triple carbonates consist of barium carbonate, calcium carbonate and strontium carbonate. Subsequently, a cathode activation process is performed to the tungsten cathode with the diffuse coating. That is, the triple carbonates are reduced to their respective oxides by passing heater current through the tungsten cathode. The diffuse coating enhances the chances of forming barium tungstate during the cathode activation process. As a result, the lamp life of the fluorescent lamp is increased and the amount of phosphor darkening is reduced. Although the above-described methods may increase the life of the fluorescent lamp or the braun tube to some degree, it is desirable to have more improved alternative methods.

SUMMARY OF THE INVENTION

The present invention relates to a method of fabricating an electrode for a discharge lamp having an increased lamp life. The Fe-Cr-Al alloy having a small difference of specific resistances between room temperature and a high temperature of about 1000° C., and a relatively high specific resistance value at the high temperature is utilized as an electrode substrate. The discharge lamp using the alloy can be operated by a small current, which in turn enables a lamp driving circuit to be reduced in size and weight. The Fe-Cr-Al alloy is placed in a heated oxidizing environment to precipitate an aluminum oxide layer uniformly in the surface thereof. Thus precipitated aluminum oxide layer has good adhesion with the alloy without flaking thereof as compared with the aluminum oxide layer formed by methods such as, for example, a sputtering method and an oxide plating method. The emitter material is then formed on the aluminum oxide layer. The emitter material includes at least one selected from alkaline earth oxides consisting of barium oxide, strontium oxide and calcium oxide. Adhesion between the emitter material and the alloy is improved by the formation of the aluminum oxide layer. Therefore, an evaporation of the emitter material from thus fabricated electrode during lamp operation is prevented, so that the lamp life of the discharge lamp is increased.

It is, therefore, a primary object of the present invention to provide a method of fabricating an electrode for a discharge lamp which comprises precipitating an aluminum oxide layer uniformly in a surface of Fe-Cr-Al alloy and forming an emitter material on the aluminum oxide layer, and the electrode formed thereby.

In the method of fabricating the electrode for the discharge lamp of the present invention, it is preferred that the Fe-Cr-Al alloy consists of 10 to 30 wt % of Cr, 1 to 10 wt % of Al and the balance of Fe. On the other hand, it is also preferred that a thickness of the aluminum oxide layer is 0.μm to 5μm to improve adhesion between the emitter material and the alloy.

The method of fabricating the electrode for the discharge lamp and the electrode formed thereby will be described hereinafter.

DETAILED DESCRIPTION OF THE INVENTION

A Fe-Cr-Al alloy wire is used to form a filament for a discharge lamp. Of course, in the present invention, a shape of the Fe-Cr-Al alloy is not limited to the filament. A specific resistance of the Fe-Cr-Al alloy is about 150μΩcm at a high temperature of about 1000° C. The specific resistance of the alloy is much higher than that of tungsten at about 1000° C. which is about 35μΩcm. Therefore, the filament of the alloy is kept to the high temperature with a small amount of current during lamp operation. The Fe-Cr-Al alloy also has a small difference of specific resistances between room temperature and the high temperature, that is, the specific resistance of the alloy at about 1000° C. is only about 1.036 times as large as that at 20° C. Therefore, immediately after a lamp voltage has been applied to operate the lamp, the discharge lamp using the filament of the alloy can be operated by a small current, which in turn enables a lamp driving circuit to be reduced in size and weight. However, the alloy wire was not used as the filament of the lamp in the past because there is a possibility of the alloy wire deforming or melting during lamp operation. And also, the alloy has a relatively high vapor pressure in a low pressure atmosphere. Therefore, the alloy is readily evaporated during the lamp operation. Thus evaporated alloy attaches on an inner surface of an envelope of the lamp so that a light output of the lamp is reduced. In the present invention, for obviating the disadvantages of the alloy wire, an aluminum oxide layer is precipitated in a surface of the alloy wire as described below. The aluminum oxide layer is capable of preventing a deformation of the alloy wire and an evaporation of the alloy wire during the lamp operation. Consequently, the alloy wire can be used as the filament.

The discharge lamp using an electrode of the present invention is fabricated in accordance with the following method. That is, the alloy wire is placed in a heated oxidizing environment, for example, in a heated air, to precipitate the aluminum oxide layer uniformly in the surface of the alloy wire. Thus precipitated aluminum oxide layer has good adhesion with the alloy wire as compared with the aluminum oxide layer formed by other methods, for example, a sputtering method and an oxide plating method. Although not fully understood, it is believed that the aluminum oxide layer precipitates in the surface of the alloy wire so as to minimize a thermal stress resulting from a difference between thermal expansion coefficients of the aluminum oxide and the alloy. It is preferred that this heat treatment is performed at about 700° C. to 1300° C. for 5 minutes to 15 hours. Subsequently, an emitter material is formed on the aluminum oxide layer. For example, an alkaline earth carbonate suspension is painted, dipped or otherwise coated on the aluminum oxide layer, so that a carbonate coated alloy wire is obtained. The carbonate suspension usually comprises barium carbonate, calcium carbonate and strontium carbonate. After the carbonate coated alloy wire is sealed within a phosphor-coated envelope, the envelope is evacuated of air. And then, an activation treatment of the carbonate coated alloy wire is performed in the envelope. That is to say, the activation treatment comprises heating the coated alloy wire in vacuum to reduce the alkaline earth carbonates to their oxides, and also to form a complex oxide consisting of the aluminum oxide and the alkaline earth oxides. The alkaline earth oxides is used as the emitter material for supplying thermo electrons. The emitter material is tightly bonded with the aluminum oxide layer through the complex oxide formed at an interface between the alkaline earth oxides and the aluminum oxide. And also, it is believed that as the aluminum oxide diffuses into grain boundaries of the emitter material during the lamp operation, the complex oxide is formed in the grain boundaries, so that adhesion between grains of the emitter material is improved. Therefore, an evaporation of the emitter material during the lamp operation is remarkably prevented. The activation treatment is performed at 800° C. to 1300° C. for a short time period. After the activation treatment, the envelope is filled with a conventional fill material including mercury and a rare gas or mixtures of rare gases such as neon and argon. By the way, it is desired that the Fe-Cr-Al alloy wire consists of 10 to 30 wt % of Cr, 1 to 10 wt % of Al and the balance of Fe. For example, KANTHAL heater wire (trade name of a heater wire manufactured by KANTHAL AB), or PYROMAX heater wire (trade name of a heater wire manufactured by RIKEN corporation), is used as the alloy wire. When an Al content in the alloy wire is less than 1 wt %, it is difficult to precipitate the aluminum oxide layer uniformly in the alloy wire. When the Al content is more than 10 wt %, a machinability of the alloy wire is lowered, very that it is so difficult to make the filament thereof. When a Cr content in the alloy wire is less than 10 wt %, it is very difficult to precipitate the aluminum oxide layer uniformly in the alloy wire because a matrix phase of the alloy is an austenite phase, and the austenite phase forms a solid solution with aluminum atoms in the alloy. When the Cr content is more than 30 wt %, the machinability of the alloy wire is lowered. It is also preferred that the difference of specific resistances of the alloy between room temperature and 1000° C. is less than 10% of the specific resistance of the alloy at the room temperature. On the other hand, It is desired that a thickness of the aluminum oxide layer is in a range of 0.1μm to 5μm. When the thickness is more than 5μm, the electrode cannot efficiently supply thermo electrons. When the thickness is less than 0.1μm, adhesion between the emitter material and the aluminum oxide layer is not improved.

The discharge lamp using the electrode fabricated in accordance with the present invention, as described above, has the following properties, that is,

[1]: The discharge lamp has a long lamp life,

]2]: The discharge lamp is capable of keeping the electrode at the high temperature with a small amount of current during lamp operation.

Further details of the present invention are described in the following Example. However, the Example is illustrative of the invention, but is not to be construed as limiting the scope thereof in any manner.

EXAMPLE

Figure 1:
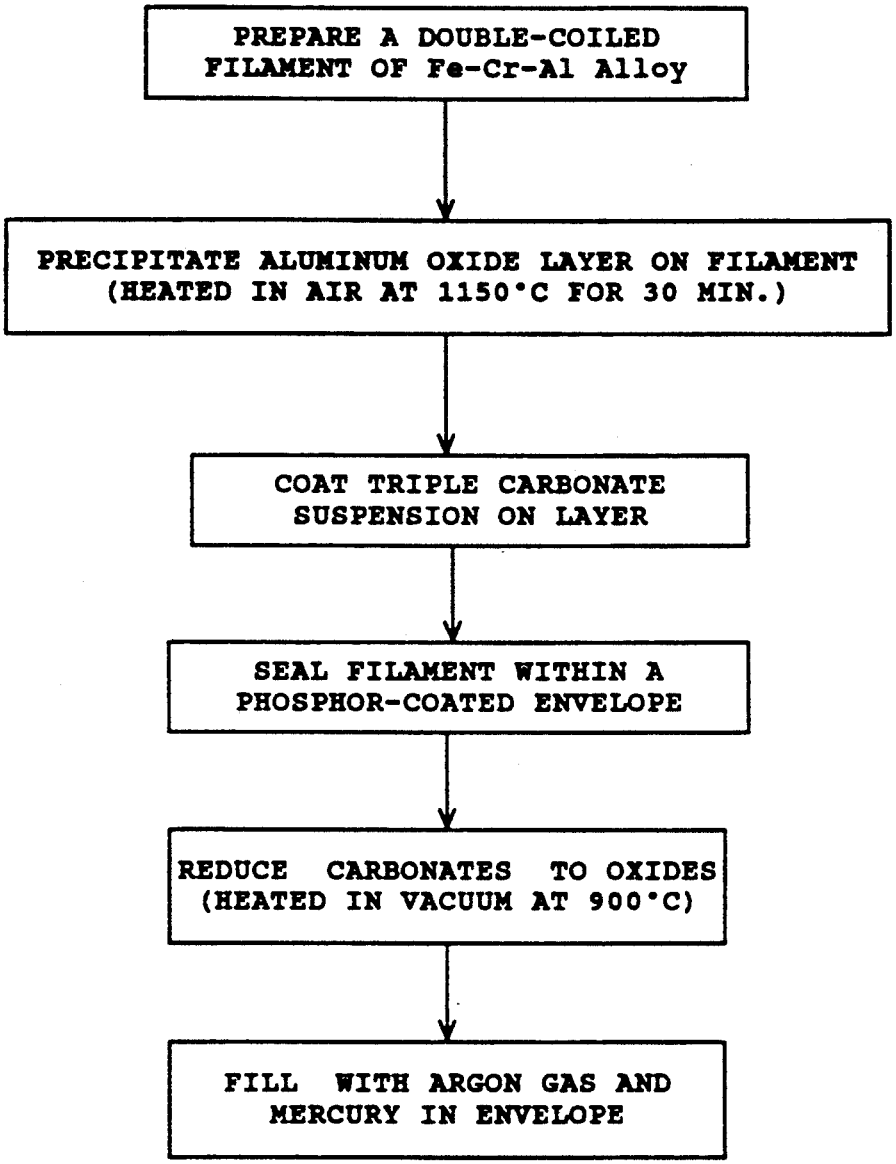
FIG. 1 is an flow chart illustrating a method of fabricating a fluorescent lamp in accordance with the principles of the present invention.

A fluorescent lamp of Example was fabricated in accordance with the following method, as shown in FIG. 1. A Fe-Cr-Al alloy wire having a composition of 22 wt % of Cr, 4.8 wt % of Al and the balance of Fe was used to form a double-coiled filament. A diameter of the alloy wire was 50μm. A diameter of a first coil of the double-coiled filament was 300μm. A diameter of a second coil of the double-coiled filament was 500μm. A total length of the double-coiled filament is 20mm. A specific resistance of the alloy at 1000° C. is only 1.036 times as large as that of the alloy at 20° C. which is about 145μΩcm. The filament was heated in an air at 1150° C. for 30min to precipitate an aluminum oxide layer uniformly in a surface thereof. Subsequently, a triple carbonate suspension comprising barium carbonate($BaCO_3$), calcium carbonate($CaCO_3$) and strontium carbonate($SrCO_3$), was coated on the aluminum oxide layer, so that a carbonate coated filament was obtained. The coated filament was sealed within a phosphor-coated envelope of the fluorescent lamp of 20W, and then the envelope was evacuated of air. An activation treatment of the coated filament was performed in thus evacuated envelope. That is, the coated filament was heated in vacuum at 900° C. by passage of current therethrough to reduce the triple carbonates to their alkaline earth oxides, and also to form a complex oxide consisting of the aluminum oxide and the alkaline earth oxides. The alkaline earth oxides functions as an emitter material for supplying thermo electrons. Adhesion between the emitter material and the aluminum oxide layer is improved by the formation of the complex oxide. After the activation treatment, the envelope was filled with argon and mercury. As a result, the fluorescent lamp of Example was fabricated.

COMPARATIVE EXAMPLE

A fluorescent lamp of Comparative Example was fabricated by the following method. A tungsten wire was used instead of the Fe-Cr-Al alloy wire. A specific resistance of the tungsten is 34.8μΩcm at 1000° C. A double-coiled tungsten filament was formed so as to have the same shape as Example. The triple carbonate suspension was coated on the tungsten filament, so that a carbonate coated tungsten filament was obtained. The coated tungsten filament was sealed within the envelope of the fluorescent lamp of 20W, and then the envelope was evacuated of air. An activation treatment of the coated tungsten filament was performed in thus evacuated envelope. That is, the coated tungsten filament was heated in vacuum at 900° C. by passage of current therethrough to reduce the triple carbonates to their alkaline earth oxides. After the activation treatment, the envelope was filled with argon and mercury. As a result, the fluorescent lamp of Comparative Example was fabricated.

The fluorescent lamps of Example and Comparative Example were examined with respect to the following factors, that is, (1): A rush current flowing through the filament immediately after a lamp voltage is applied to operate the lamp, (2): A lamp life in case that the lamp is continuously operated with 2 amperes of a discharge current.

As shown in TABLE 1, the lamp of Example has a smaller rush current than that of Comparative Example. Therefore, the discharge lamp of Example can be operated by a smaller current compared with the lamp of Comparative Example, which in turn enables a lamp driving circuit to be reduced in size and weight. On the other hand, the lamp life of Example is more than two times as long as that of Comparative Example. This result indicates that the lamp of Example has an improved adhesion between the emitter material and the filament, so that the lamp life is remarkably increased.

TABLE 1

Lamp performance of fluorescent lamps of Example and Comparative Example.

| Factors | Example | Comparative Example |
|---|---|---|
| Rush current (A) | 0.9 | 4.1 |
| Lamp life (hours) | 1457 | 638 |

What is claimed is:

1. A method of fabricating an electrode for a discharge lamp, said method comprising the steps of:
   preparing an electrode substrate made of a Fe-Cr-Al alloy;
   heating said electrode substrate in an oxidizing environment to form an aluminum oxide layer in the surface of said electrode substrate; and
   coating an emitter material on the surface of the aluminum oxide layer.

2. A method as set forth in claim 1, wherein said Fe-Cr-Al alloy consists of 10 to 30 wt % of Cr, 1 to 10 wt % of Al and the balance of Fe.

3. A method as set forth in claim 1, wherein a thickness of said aluminum oxide layer is in a range of 0.1 to 5μm.

4. A method as set forth in claim 1, wherein said emitter material includes at least one selected from alkaline earth oxides consisting of barium oxide, strontium oxide and calcium oxide.

5. A method as set forth in claim 1, wherein said electrode substrate is heated at a temperature of 700° C. to 1300° C. to form said aluminum oxide layer by precipitation.

6. A method as set forth in claim 1, wherein a difference of specific resistances of said Fe-Cr-Al alloy between at a room temperature and 1000° C. is less than 10% of said specific resistance at the room temperature, said room temperature being in a range of 0° C. to 40° C.

7. An electrode for a discharge lamp fabricated by a method comprising the steps of:
   preparing an electrode substrate made of a Fe-Cr-Al alloy;

heating said electrode substrate in an oxidizing environment to form an aluminum oxide layer in the surface of said electrode substrate; and coating an emitter material on the surface of the aluminum oxide layer.

8. An electrode as set forth in claim 7, wherein said Fe-Cr-Al alloy consists of 10 to 30 wt % of Cr, 1 to 10 wt % of Al and the balance of Fe.

9. An electrode as set forth in claim 7, wherein a thickness of said aluminum oxide layer is in a range of 0.1 to 5μm.

10. An electrode as set forth in claim 7, wherein said electrode substrate is heated at a temperature of 700° C. to 1300° C. to form said aluminum oxide layer by precipitation.

11. An electrode as set forth in claim 7, wherein said emitter material includes at least one selected from alkaline earth oxides consisting of barium oxide, strontium oxide and calcium oxide.

12. An electrode as set forth in claim 7, wherein a difference of specific resistances of said Fe-Cr-Al alloy between at a room temperature and 1000° C. is less than 10% of said specific resistance at the room temperature, said room temperature being in a range of 0° C. to 40° C.

13. A method of manufacturing a fluorescent lamp comprising preparing a filament made of a Fe-Cr-Al alloy;

heating said filament in an oxidizing environment to form an aluminum oxide layer in the surface of said filament;

coating the surface of said aluminum oxide layer with triple carbonates;

sealing said filament with said aluminum oxide layer and said triple carbonates within a phosphor-coated envelope;

reducing said triple carbonates to their oxides by passage of current through said filament;

evacuating said envelope; and filling with an rare gas and mercury in said envelope

14. A method as set forth in claim 13, wherein said Fe-Cr-Al alloy consists of 10 to 30 wt % of Cr, 1 to 10 wt % of Al and the balance of Fe.

15. A method as set forth in claim 13, wherein said triple carbonates consist of barium carbonate, strontium carbonate and calcium carbonate.

16. A method as set forth in claim 13, wherein a thickness of said aluminum oxide layer is in a range of 0.1 to 5μm.

17. A method as set forth in claim 13, wherein said filament is heated at a temperature of 700° C. to 1300° C. to form said aluminum oxide layer be precipitation.

* * * * *